US010619551B2

(12) United States Patent
Angelle

(10) Patent No.: US 10,619,551 B2
(45) Date of Patent: Apr. 14, 2020

(54) BOAT HULL COOLING AND MARINE-DRIVE SYSTEM

(71) Applicant: Clinton J. Angelle, Breaux Bridge, LA (US)

(72) Inventor: Clinton J. Angelle, Breaux Bridge, LA (US)

( * ) Notice: Subject to any disclaimer, the term of this patent is extended or adjusted under 35 U.S.C. 154(b) by 0 days.

(21) Appl. No.: 16/004,343

(22) Filed: Jun. 9, 2018

(65) Prior Publication Data

US 2018/0355782 A1 Dec. 13, 2018

Related U.S. Application Data

(60) Provisional application No. 62/517,411, filed on Jun. 9, 2017.

(51) Int. Cl.

| | |
|---|---|
| ***F01P 3/20*** | (2006.01) |
| ***B63H 20/10*** | (2006.01) |
| ***B63B 3/14*** | (2006.01) |
| ***B63J 2/12*** | (2006.01) |
| ***B63H 20/00*** | (2006.01) |

(52) U.S. Cl.

CPC ..... *F01P 3/207* (2013.01); *B63B 3/14* (2013.01); *B63H 20/001* (2013.01); *B63H 20/10* (2013.01); *B63J 2/12* (2013.01); *B63B 2770/00* (2013.01)

(58) Field of Classification Search

CPC ..... B63H 20/00; B63H 20/001; B63H 20/10; B63H 20/24; B63H 20/245; B63H 20/28; B63H 20/285; B63H 39/00; B63H 39/06; B63H 25/00; B63H 25/06; B63H 25/38; F01P 3/00; F01P 3/207; B63B 3/00; B63B 3/14; B63J 2/00; B63J 2/12

USPC ..... 440/88 C

See application file for complete search history.

(56) References Cited

U.S. PATENT DOCUMENTS

| | | | | |
|---|---|---|---|---|
| 941,827 | A | 11/1909 | Trouche | |
| 2,386,803 | A * | 10/1945 | Jutte | B63H 25/38 440/88 C |
| 3,650,310 | A * | 3/1972 | Childress | B63H 20/285 440/88 C |
| 4,239,013 | A * | 12/1980 | Haynes | B63H 11/04 440/40 |
| 5,328,396 | A | 7/1994 | Hayasaka | |
| 5,349,818 | A | 9/1994 | McFadyen et al. | |
| 6,042,434 | A | 3/2000 | Nakamura | |
| 6,361,388 | B2 | 3/2002 | Foreman | |
| 6,558,212 | B2 | 5/2003 | Saito | |
| 6,607,410 | B1 | 8/2003 | Neisen et al. | |
| 7,254,945 | B1 | 8/2007 | Sakai et al. | |
| 7,297,035 | B2 | 11/2007 | Broussard | |
| 8,277,266 | B2 | 10/2012 | Inoue et al. | |

(Continued)

FOREIGN PATENT DOCUMENTS

| | | |
|---|---|---|
| EP | 0869056 | 7/1998 |

*Primary Examiner* — Lars A Olson

(57) ABSTRACT

A boat hull cooling and marine-drive system intended for use in a primary shallow water bottom environment includes a boat hull with an integrated internal engine heat exchanger, marine drive system and steering assembly. The steering assembly incorporates a ring-within-a-ring steering mechanism and an obstacle resistant shoe plate. Stabilizer fins positioned above the shoe plate at a position forward of the spinning propeller allow air and water to exit from the rear of the stabilizer fins away from the spinning propeller.

18 Claims, 12 Drawing Sheets

(56) References Cited

U.S. PATENT DOCUMENTS

| | | | | |
|---|---|---|---|---|
| 9,132,902 | B2 | 9/2015 | Angelle | |
| 9,580,159 | B1 * | 2/2017 | Provost | B63H 20/28 |
| 9,845,139 | B1 * | 12/2017 | Provost | B63H 20/28 |
| 2011/0033298 | A1 | 2/2011 | Misao | |
| 2012/0114368 | A1 | 5/2012 | Koide et al. | |

* cited by examiner

BOAT HULL COOLING AND MARINE-DRIVE SYSTEM

PRIORITY

This application claims priority to U.S. Provisional Application Ser. No. 62/517,411 filed Jun. 9, 2017 for "Boat Hull Cooling and Marine Drive system", the entire content of which is incorporated by reference.

FIELD OF INVENTION

This invention relates to boat hull cooling and boat drive systems and, more particularly, to a combined boat hull cooling and drive system for boats used in shallow, marshy, or swampy waterways or where underwater obstructions are likely to be encountered.

BACKGROUND OF THE INVENTION

The engines of boats having a water-cooled engine as part of the drive system are cooled by drawing and circulating water obtained from the waterway during operation of the boat. When a boat having a water cooled drive system is used in shallow waterways, shallow marshes, or swamps, obstructions including floating and underwater vegetation, tree limbs, branches, roots, mud bottoms, rocks, and reefs are likely to be encountered. These obstructions may prevent the circulation of water from the waterway making the engines of such boats prone to overheating. When a boat having a water-cooled engine as part of the drive system is operated in an extremely shallow waterway that consists mainly of a slurry of water, vegetation, mud, sand and other debris, such waterway is often unsuitable for providing circulating water for cooling the engine.

Some boats incorporate engine cooling systems, called keel cool systems that have heat exchangers that extend from the bottom of the boat hull surfaces or that are placed in recesses on the bottom of the boat hull. Such keel cool systems are unsuitable for cooling a boat engine when the boat is operated in extremely shallow water environments due to the risk of damage to the boat hull and the cooling system caused when the boat strikes or engages the water bottom and because mud and other debris in the water environment will coat or become lodged around the heat exchangers and reduce their effectiveness in cooling the engine of the drive system.

Many boats have a drive assembly that incorporate fins and cavitation plates around the propeller in order to retain and maintain water slurry around the spinning propeller to prevent incidences of ventilation and cavitation and the loss propeller thrust. However, when boats utilizing such orienting fins and cavitation plates are operated in a shallow water environment where a slurry of water, mud, sand and other debris is present, such operation often results in damage to the drive shafts, bearings, seals and bushings contained in the drive assembly of the boat. This will lead to breakdowns and the cost and inconvenience of retrieval of the boat from a remote location along with associated costly boat repairs.

Some boats have a drive assembly with a skeg that extends downward from the bottom of the boat hull or from an elongated rudder or drive shaft. The lower surfaces of such skegs generally are angled at intersecting straight lines or the lower surfaces of such skegs are angled on intersecting straight line surfaces and corresponding curve surfaces. Such skeg shapes are generally unsuitable for shallow water environments. Such skeg shapes are more likely to engage and contact the water bottom or other obstructions and damaged because their shapes do not allow for a smooth or consistent transition over obstacles encountered in the waterway as the boat is propelled.

Some boats have a drive assembly with an extending drive shaft that pivots both up and down and right and left for steering the boats. The pivot assemblies on such a drive assembly provide a weak link in the assembly and are easily damaged when obstructions are encountered.

Consequently, there is a need for a boat for use in shallow water environments having an improved drive system for that will minimize or eliminate the risk of drive system damage caused by waterway obstructions.

SUMMARY OF THE INVENTION

The invention is a boat hull cooling and drive system combination for boats intended for use in shallow, marshy, or swampy waterways where underwater obstructions are likely to be encountered. The boat hull is provided with a shallow bottom hull surface and an integrated internally positioned onboard engine heat exchanger assembly that does not protrude from the bottom surface of the boat hull. The drive assembly includes a ring-within-a-ring steering mechanism, an obstacle resistant shoe plate, and stabilizer fins positioned above the shoe plate at a position forward of spinning propeller. The forward position of the stabilizer fins allows air, water, and potentially clogging debris to exit from the rear of the stabilizer fins away from the spinning propeller to prevent damage to the drive shafts, bearings, seals and bushings of the drive assembly of the boat.

Figure 1:
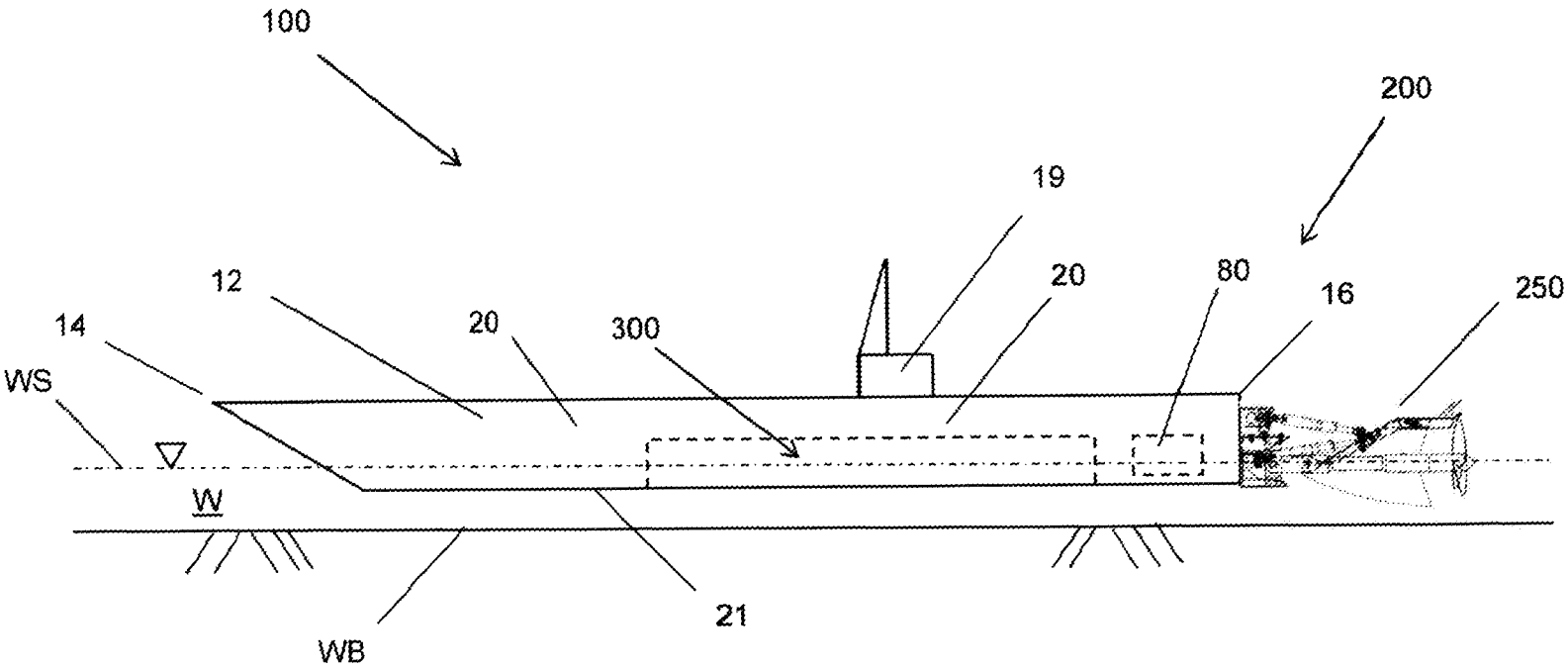
FIG. 1 is a schematic side view diagram view of the combined boat hull cooling and marine-drive system of this invention.

In the Drawings and following Description of the Embodiments, features that are well known and established in the art and do not bear upon points of novelty are omitted in the interest of descriptive clarity. Such omitted features include fluid lines, fluid tanks, switches, pumps, valves, threaded junctures, tubing clamps, flanged connections, check valves, weld lines, universal joint descriptions, pivoting connection descriptions, sealing elements, pins, brazed junctures, bearings, bolts, and screws.

DESCRIPTION OF THE EMBODIMENTS

Figure 2:
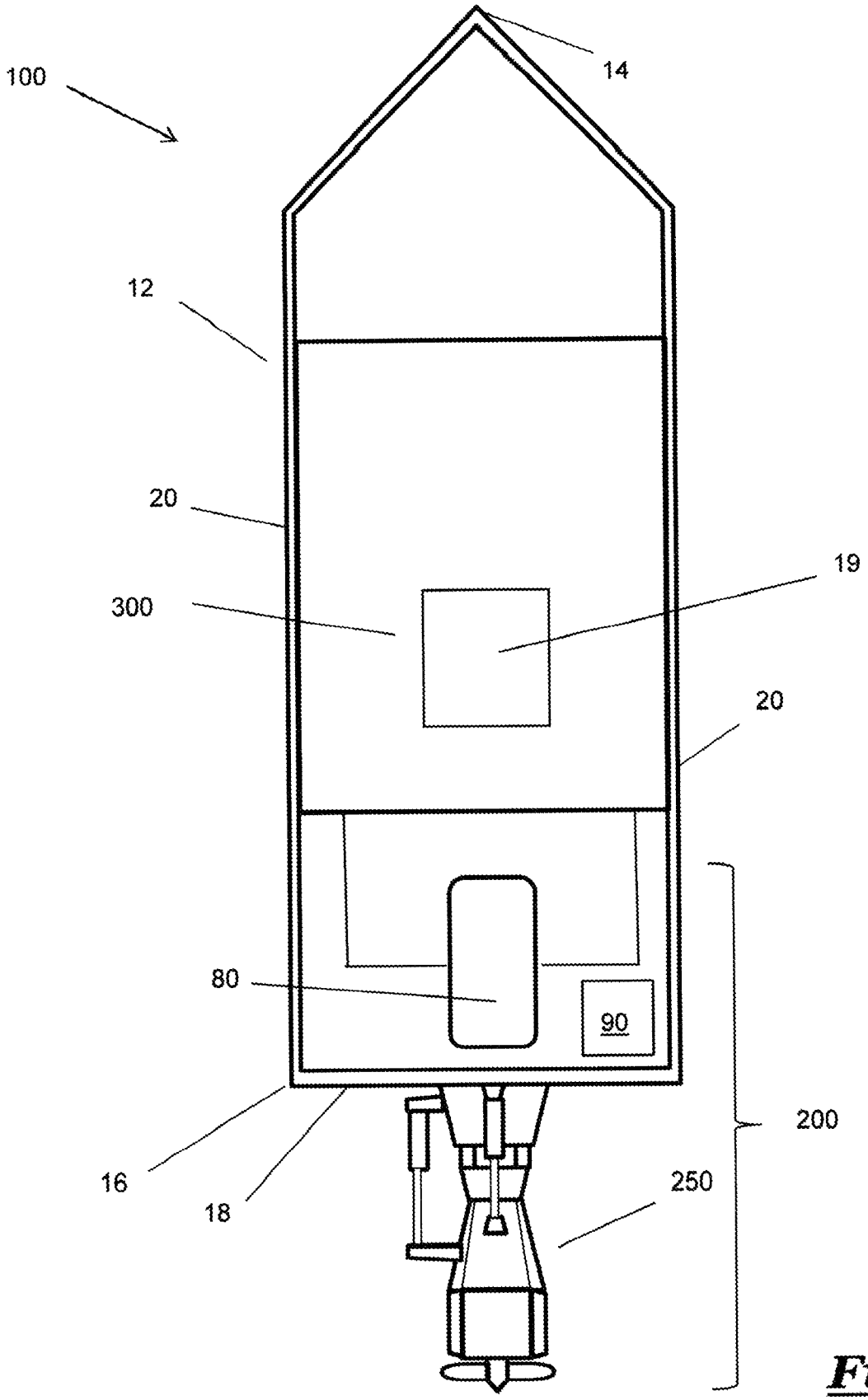
FIG. 2 is a schematic top view showing the boat hull and the integrated internally positioned onboard engine heat exchanger assembly of the combined boat hull cooling and marine-drive system of FIG. 1.
Figure 3:
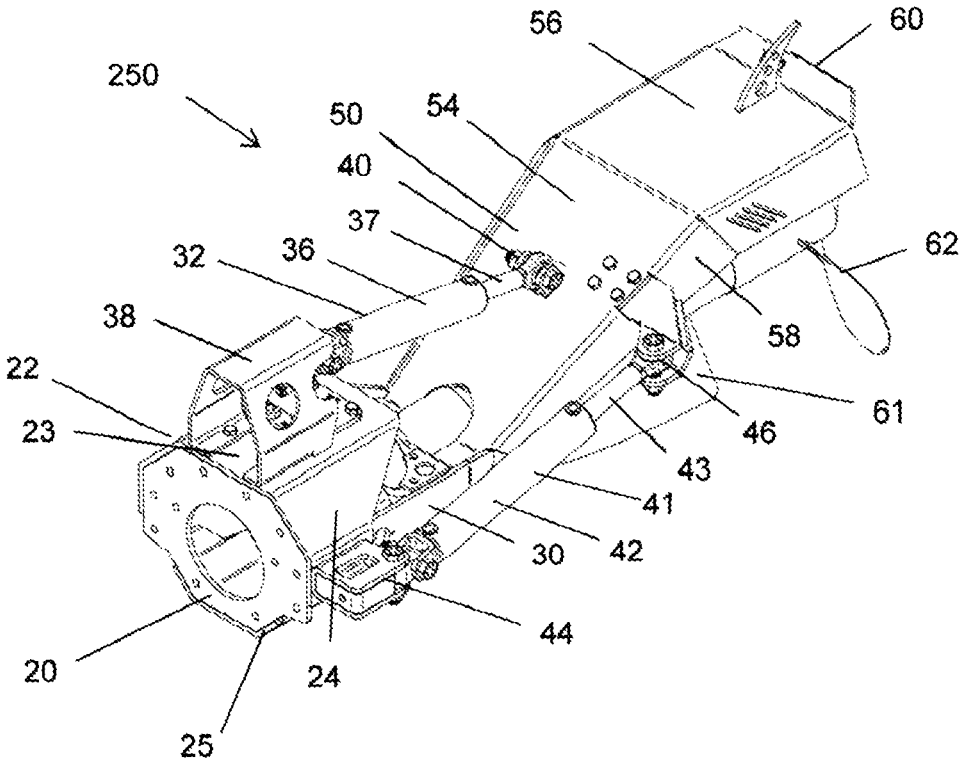
FIG. 3 is a perspective view of the steering, propeller, stabilizer, and shoe plate assembly of the marine-drive system of the combined boat hull cooling and marine-drive system of FIG. 1.
Figure 4:
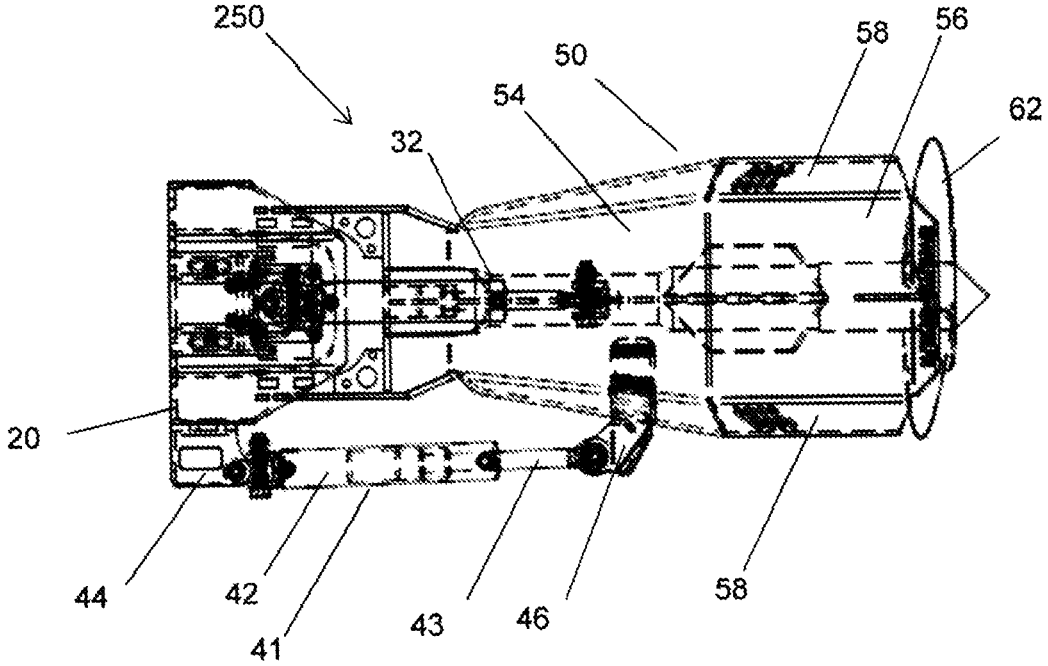
FIG. 4 is a top view of the steering, propeller, stabilizer, and shoe plate assembly of the marine-drive system of the combined boat hull cooling and marine-drive system of FIG. 1.
Figure 5:
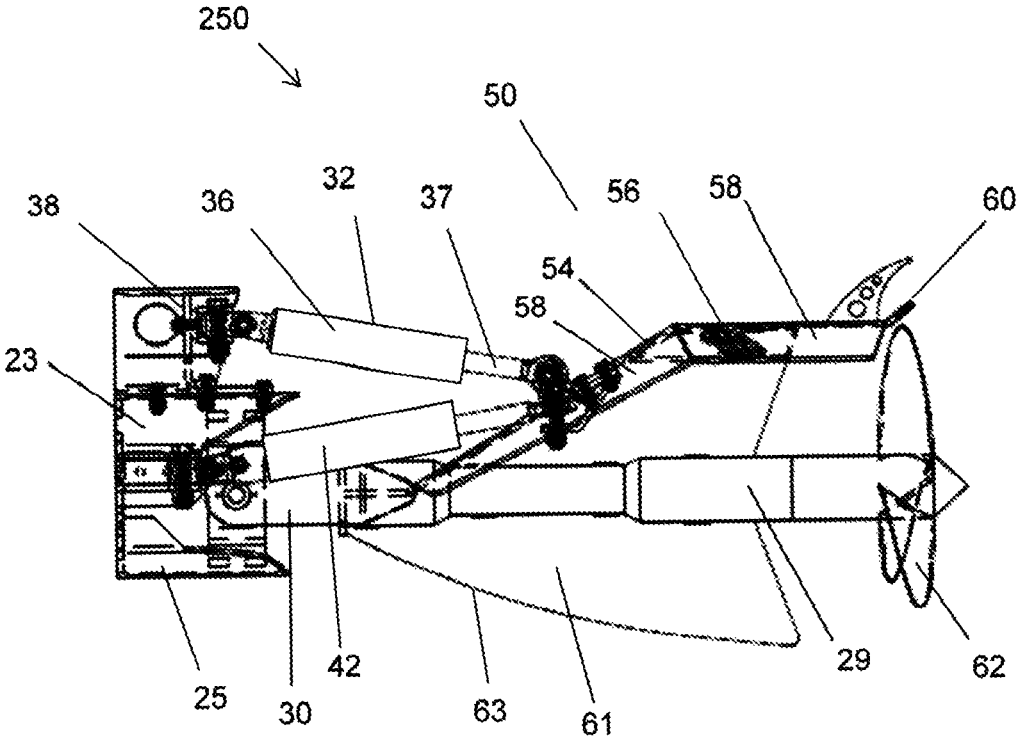
FIG. 5 is a side view of the steering, propeller, and shoe plate assembly of the marine-drive system of FIG. 1.
Figure 6:
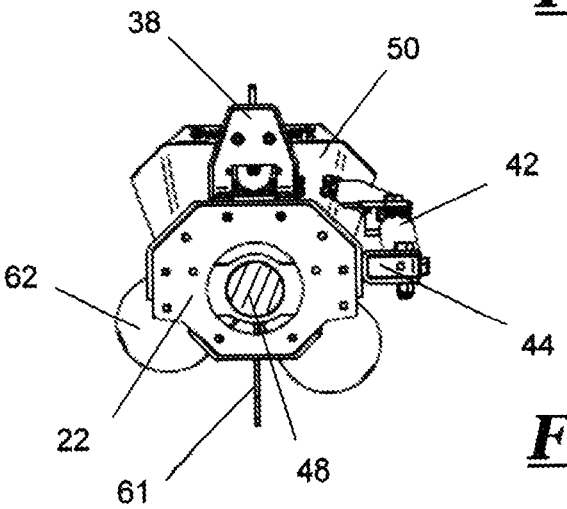
FIG. 6 is an end view showing the boat transom attachment plate of the steering, propeller, stabilizer, and shoe plate assembly of the marine-drive system of the combined boat hull cooling and marine-drive system of FIG. 1.

FIGS. 1 and 2 are schematic views of the boat hull cooling and marine-drive system (100) for boats intended for use in shallow, marshy, or swampy waterways where underwater obstructions are likely to be encountered. The boat hull cooling and marine-drive system (100) includes a boat hull (12), a marine-drive assembly (200) that includes steering assembly (250) attached to the boat hull (12), a fluid cooled motor or engine (80), and an integrated internally positioned onboard engine heat exchanger assembly (300) incorporated within the boat hull (12). A control cockpit (19) is as also positioned within the boat hull (12).

Figure 10:
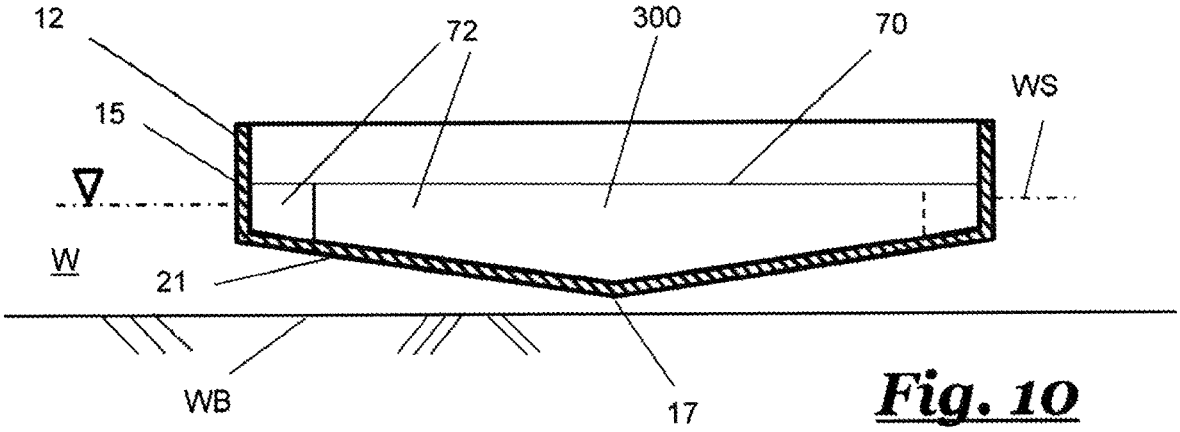
FIG. 10 is a schematic cross-section view of the improved boat hull cooling and marine-drive system shown in FIG. 9 showing the integrated internally positioned onboard engine heat exchanger assembly of the marine-drive system of the combined boat hull cooling and marine-drive system of FIG. 1.
Figure 12:
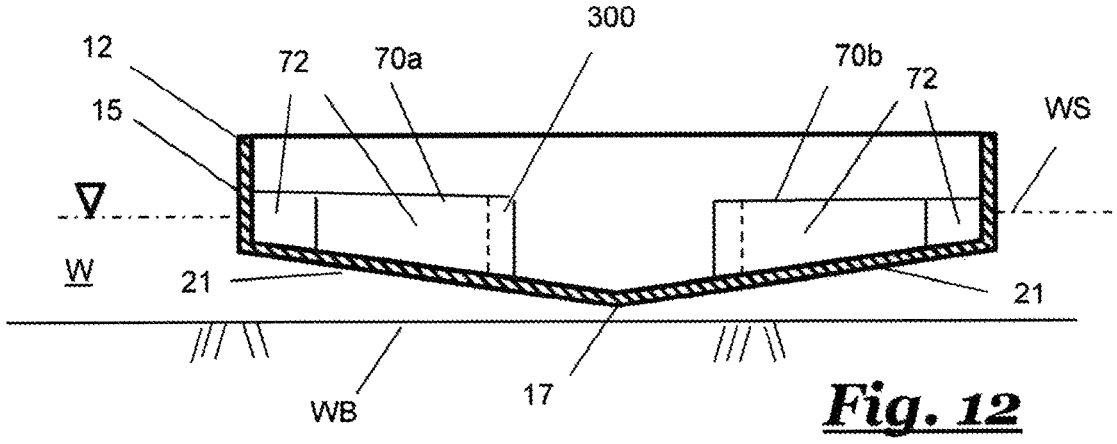
FIG. 12 is a schematic cross-section view of a boat hull showing the integrated internally positioned onboard engine heat exchanger assembly of the marine-drive system shown in FIG. 1 with the dual heat exchangers shown in FIG. 11.
Figure 15:
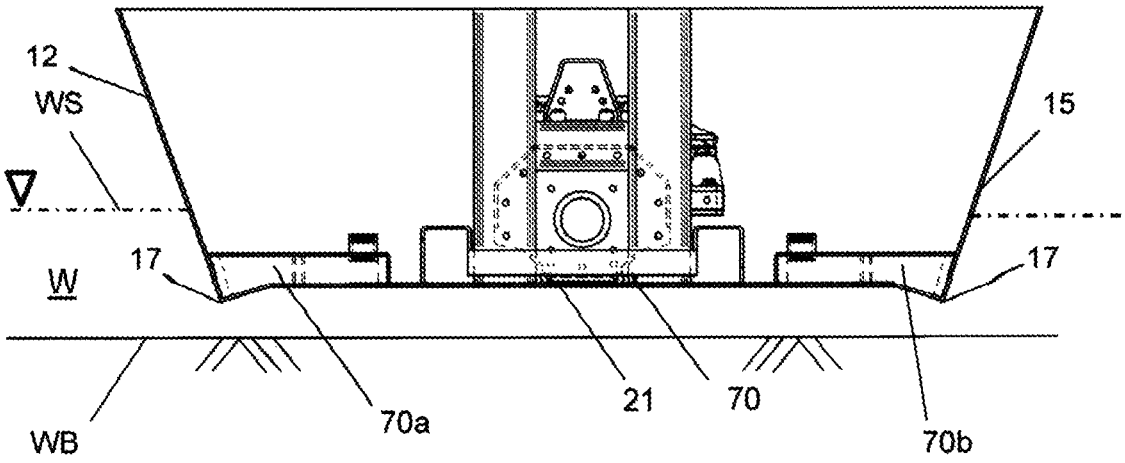
FIG. 15 is a schematic cross-section view of the combined boat hull cooling and marine-drive system of FIG. 1 showing the vertical range of motion of the drive system, the boat hull having a flat boat and dual heat exchangers of the type shown in FIG. 11.

The boat hull (12) has a bow (14), a stern (16), sidewalls (15), a bottom surface (21), and a transom (18). It is thought that the bottom surface (21) of the boat hull (12) will be flat or substantially flat shown in FIG. 15 or the bottom surface (21) of the boat hull (12) may have a shallow V-shape as shown in FIGS. 10 and 12 to minimize contact with the water bottom (WB) when the boat is loaded and operating on the water surface (WS) of a waterway (W). The bottom surface (21) of the boat hull (12) may also have a curved shape or a more pronounced V-shape depending upon the environment in which the boat is to be utilized. The keel projections (17) on the bottom surface (21) of the boat hull (12) may be only those only minimally necessary as may be required for steering and stability of the boat hull (12) during operation so as to minimize water bottom contact and contact with potential obstructions.

The steering assembly (250) is shown in FIGS. 3-7. The steering assembly (250) has a transom attachment plate (20) where the steering assembly (250) may be bolted or otherwise attached to the transom (18) of the boat hull (12). Attached to the transom attachment plate (20) is an upper drive assembly support plate (23) and a lower drive assembly support plate (25). A ring-within-a-ring turning assembly (22) comprised of an outer ring (24) and an inner ring (26), is pivotally mounted between the drive assembly support plates (23) and (25).

Figure 7:
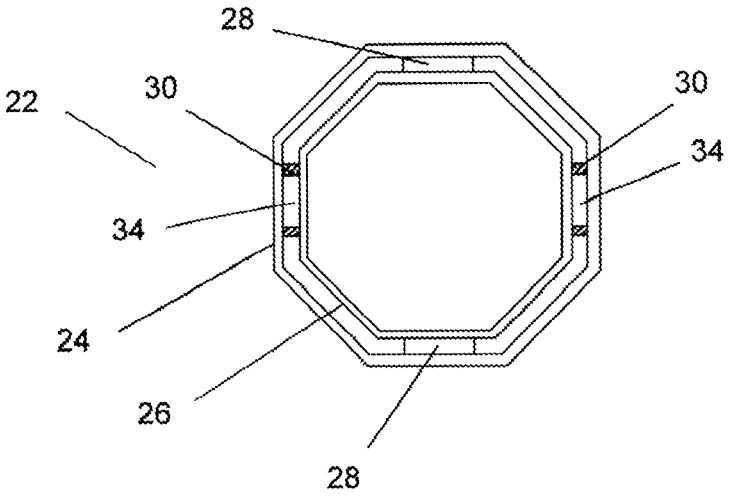
FIG. 7 is a schematic cross-section view of the ring-within-a-ring steering mount of the steering, propeller, stabilizer, and shoe plate assembly of the marine-drive system of the combined boat hull cooling and marine-drive system of FIG. 1.

The inner ring (26) of the ring-within-a-ring turning assembly (22) is pivotally mounted within the outer ring (24) by upper and lower ring steering pivot bearings (28), as shown in FIG. 7, to allow the inner ring (26) to pivot horizontally within the outer ring (24). A pair of drive shaft housing supports (30) are pivotally mounted on drive shaft elevator pivot bearings (34) on opposite sides of the outer ring (24) of the ring-within-a-ring turning assembly (22) to allow the drive shaft housing supports (30) to pivot vertically.

The ring-within-a-ring turning assembly (22) is shown with outer ring (24) and an inner ring (26) as symmetrical octagonal rings. However, the outer and inner rings made be formed as other geometric shapes circular rings. An outer ring (24) and an inner ring (26) of a symmetrical shape such as a circle or octagonal shape will serve to better enhance the rigidity and strength of the turning assembly (22) and distribute the working loads and forces induced on the steering assembly (250) during operation of the boat hull cooling and marine-drive system (100).

A longitudinally extending drive shaft housing (29) is mounted to the drive shaft housing supports (30) so that it extends rearward from the ring-within-a-ring turning assembly (22). Drive shaft housing (29) houses a rotatable mounted drive shaft (48). The drive shaft (48) is attached to a transmission assembly of the boat engine (80) to transmit torque and rotation to the propeller (62).

Figure 13:
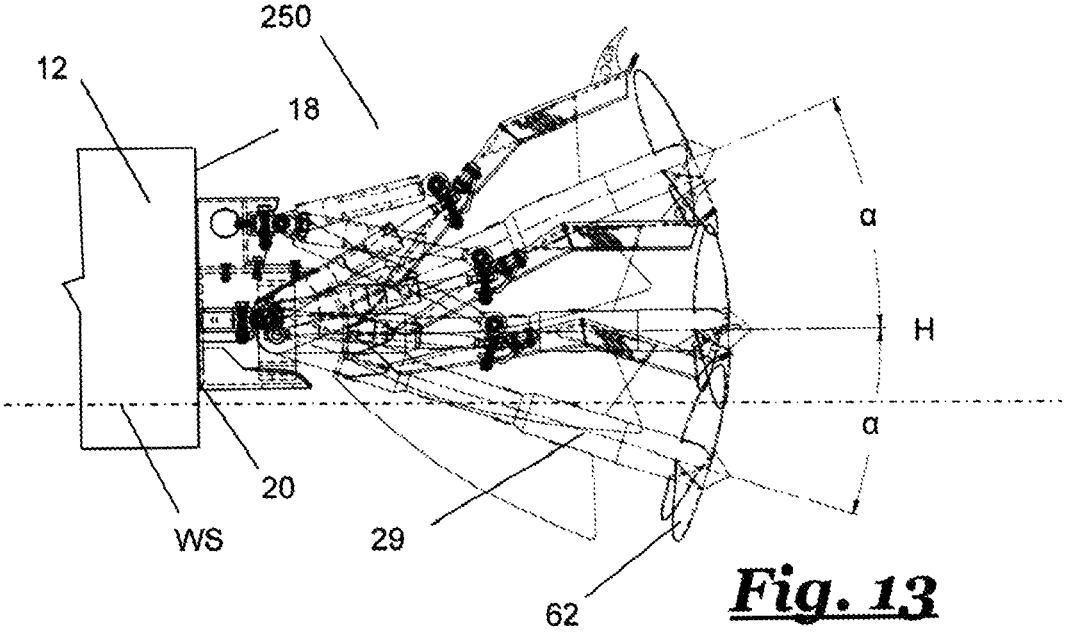
FIG. 13 is a schematic side view of the steering, propeller, stabilizer, and shoe plate assembly of the marine-drive system

A drive shaft elevator assembly (32) is used to pivotally raise and lower the extending drive shaft housing (29). Drive shaft elevator assembly (32) is comprised of a drive shaft elevator hydraulic cylinder (36) having an extendable and retractable elevator piston rod (37). The elevator hydraulic cylinder (36) is pivotally attached to a drive shaft elevator cylinder support bracket (38) mounted on upper support drive assembly support plate (23). The elevator piston rod (37) is pivotally attached to a drive shaft elevator piston support bracket (40) mounted on the drive shaft housing (29). Extension of the elevator piston rod (37) from elevator hydraulic cylinder (36) will lower the drive shaft housing (29). Retraction of the elevator piston rod (37) into the elevator hydraulic cylinder (36) will raise the drive shaft housing (29). FIG. 13 shows the vertical range of motion of the drive shaft housing (29) and the enclosed drive shaft (48) and propeller (62) to the left and right, i.e., toward the port side or toward the starboard side of the boat hull (12) along angle $\alpha$ above and below the horizontal (H).

A lateral turning assembly (41) is used to pivotally turn the ring-within-a-ring turning assembly (22) and thus move drive shaft housing (29) transversely to the left and right, i.e., toward the port side or toward the starboard side of the boat hull (12) of the boat hull cooling and marine-drive system (100). The lateral turning assembly (41) is comprised of a drive shaft steering hydraulic cylinder (42) having an extendable and retractable steering piston (43). The steering hydraulic cylinder (42) is pivotally attached to a drive shaft steering cylinder support bracket (44) mounted on a drive shaft housing support (30). The steering piston (43) is pivotally attached to a drive shaft steering piston support bracket (46) mounted on a stabilizer assembly (50) attached to the drive shaft housing (29).

Figure 14:
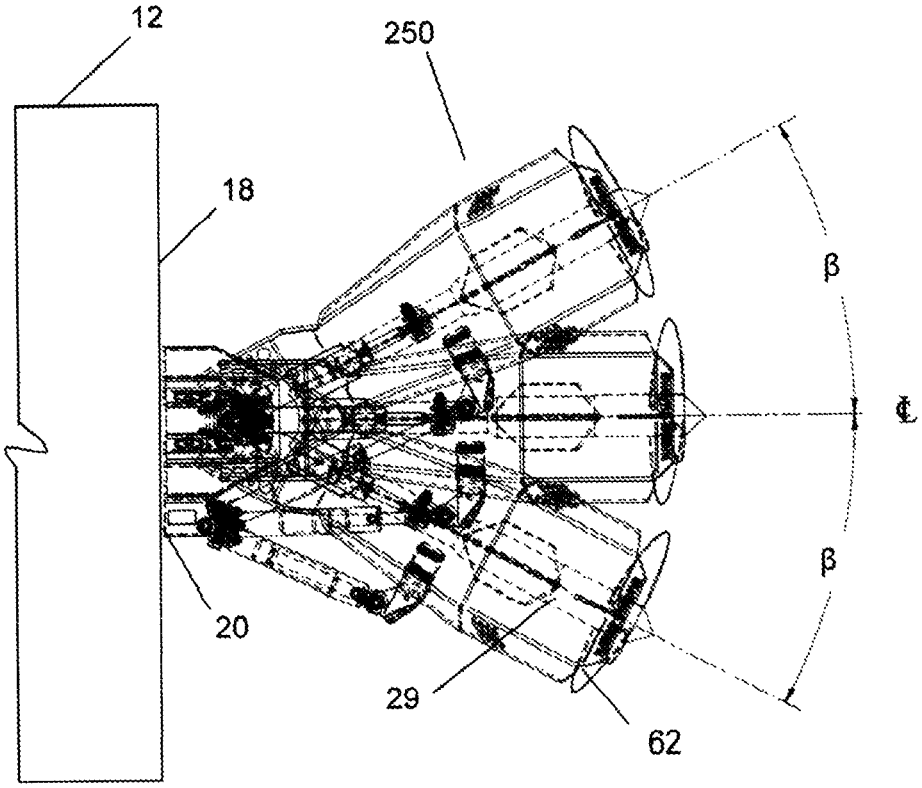
FIG. 14 is a schematic cross-section view of the steering, propeller, stabilizer, and shoe plate assembly of the marine-drive system of the combined boat hull cooling and marine-drive system of FIG. 1 showing the horizontal or lateral range of motion of the drive system.

Extension of the steering piston (43) from steering hydraulic cylinder (42) will pivot the drive shaft housing (29) horizontally to the right or starboard side of the boat hull (12) of the boat hull cooling and marine-drive system (100). Retraction of the steering piston (43) into the steering hydraulic cylinder (42) will pivot the drive shaft housing (29) to the left or port side of the boat hull (12) of the boat hull cooling and marine-drive system (100). FIG. 14 shows the lateral range of motion of the drive shaft housing (29) and the enclosed drive shaft (48) and propeller (62) to the left and right, i.e., toward the port side or toward the starboard side of the boat hull (12) along angle β from the centerline (℄) of the boat hull (12).

A universal joint (not shown) attached to drive shaft (48) is configured to allow the drive shaft housing (29) and the enclosed rotatable drive shaft (48) to be selectively pivoted both vertically, i.e., upward or downward with respect to the bottom (21) of the boat hull (12), and horizontally, i.e., toward the port or starboard side of the boat hull (12).

The elevator hydraulic cylinder (36) of the hydraulic drive shaft elevator assembly (32) used to pivotally lift and lower the extending drive shaft housing (29) is preferably manipulated from the control cockpit (19) by a control system (90) positioned in the boat hull (12). Elevator hydraulic cylinder (36) and the control system (90) for controlling the flow of hydraulic fluid to and from elevator hydraulic cylinder (36) for pivotally raising and lowering the drive shaft housing (29) and thus the connected propeller (62) is disclosed in detail in Applicant's U.S. Pat. No. 9,132,902, entitled Marine-drive system and Method.

As disclosed, described, and illustrated in U.S. Pat. No. 9,132,902, incorporated herein by reference, piston rod (37) of elevator hydraulic cylinder (36) will be attached to a cylinder piston positioned between first and second cylinder areas in the elevator hydraulic cylinder (36). A spring in the first cylinder area will translate the piston to extend piston rod (37) to lower the drive shaft housing (29) and the associated propeller (62) as a default position. A first cylinder area flow line is provided from the first cylinder area of elevator hydraulic cylinder (36) to a fluid reserve tank where fluid from the first cylinder area is evacuated. Fluid flow from the first cylinder area flow line to the fluid reserve tank is controlled by an electric solenoid valve having a selectively positionable multifunction switch. The first cylinder area flow line includes a switch controlled pump and a fluid supply line for delivering fluid from a fluid supply tank. A fluid relief flow line with a switch controlled fluid relief valve controls fluid flow from the second cylinder area of elevator hydraulic cylinder (36). Controlled flow of fluid moving to and from the fluid reserve tank and the elevator hydraulic cylinder (36) will correspondingly adjust pressure on the hydraulic cylinder piston to compress the internal spring to retract elevator piston rod (37) of elevator hydraulic cylinder (36). Retraction of the elevator 61 piston rod (37) by the adjusted pressure of the hydraulic fluid on the piston of elevator hydraulic cylinder (36) raises the drive shaft housing (29) and thus the connected propeller (62) to a pressure mode position.

The control system (90) may also include a trim system having a hydraulic fluid trim pump having an up trim mode and a down trim mode operatively connected to the elevator hydraulic cylinder (36) and the hydraulic fluid supply tank. The fluid trim pump allows for adjustment of the vertical position of the drive shaft (48) to a desired position or trim during vessel operation.

The lateral turning assembly (41) providing horizontal movement of the drive shaft housing (29) and the retained rotatable drive shaft (48) of the steering assembly (250) may be provided with and adapted to a steering mechanism that is also controlled from the control cockpit (19). It is thought that a hydraulic marine steering mechanism will be utilized, but a variety of marine steering mechanisms including a cable system may also be utilized.

The stabilizer assembly (50) is utilized to move air and water away from the spinning propeller (62) as it is exiting from the rear of the drive shaft housing (29) and stabilizer assembly (50). The stabilizer assembly (50) is comprised of a stabilizer support (52) that extends vertically upward from the drive shaft housing (29). Attached at right angles to the stabilizer support (52) are a diagonal stabilizer (54) and a horizontal stabilizer (56). Vertically downwardly angled stabilizer side fins (58) extend from diagonal stabilizer (54) and a vertically upwardly angled rear fin (60) extends rearward from the horizontal stabilizer (56). The stabilizer assembly (50) channels air and water along the drive shaft housing (29) as the boat hull (12) of the boat hull cooling and marine-drive system (100) is propelled forward. Because the horizontal stabilizer (56) terminates forward or ahead of the propeller (62), channeled air, water, and churned up mud and debris is allowed to exit from the stabilizer assembly (50) away from the spinning propeller (62) so as not to impede its rotation and ability to provide thrust to the boat hull (12) of the boat hull cooling and marine-drive system (100).

Figure 8:
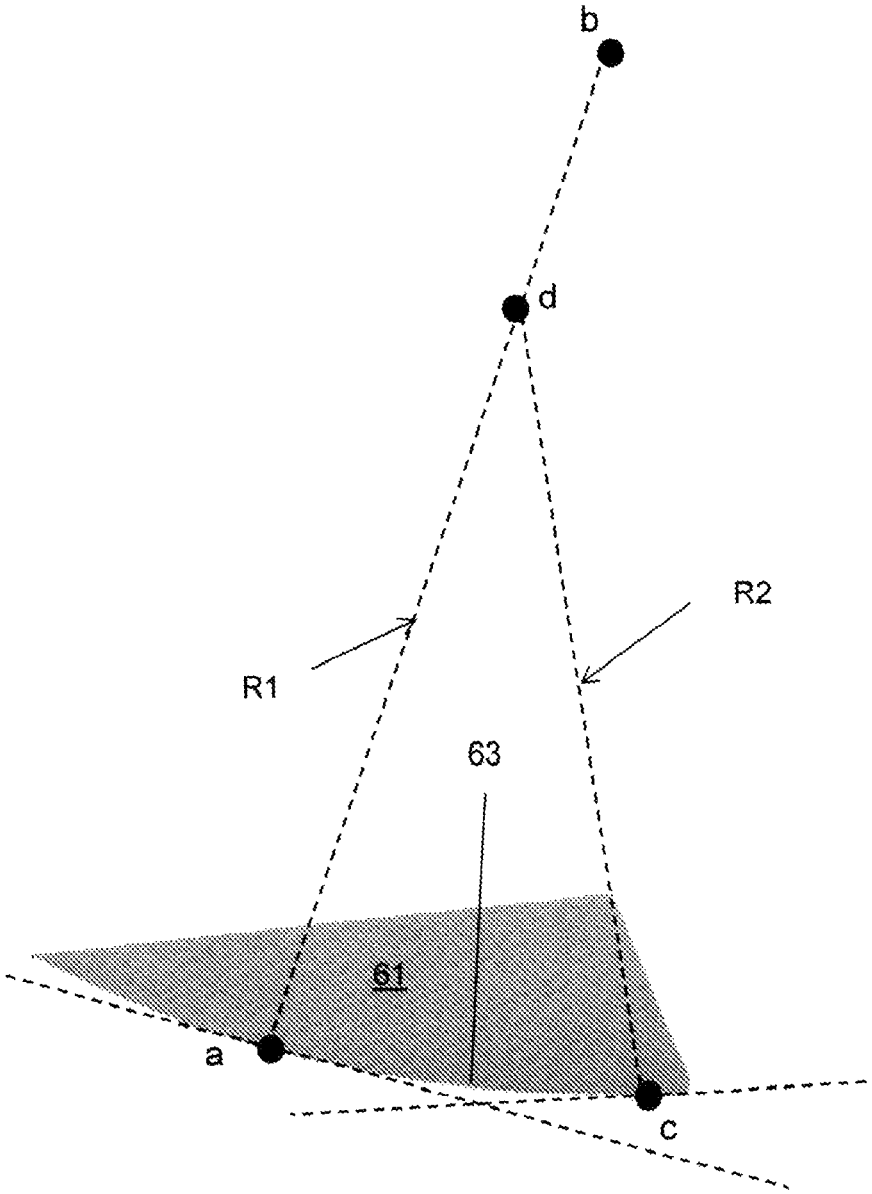
FIG. 8 is a schematic diagram of the compound curve shoe plate profile of the shoe plate of the steering, propeller, stabilizer, and shoe plate assembly of the marine-drive system of the combined boat hull cooling and marine-drive system of FIG. 1.

The stabilizer assembly (50) is further provided with a shoe plate (61) that extends vertically downward from the drive shaft housing (29). The shoe plate (61) has a bottom edge (63) that serves as a bumper to pivot the drive shaft housing (29) with the enclosed drive shaft (48) and propeller (62) upward away for obstacles encountered during propulsion of the boat hull (12). As shown in FIG. 8, the bottom edge (63) of the shoe plate (61) is comprised of a compound curve having a forward curve (63*a*) that has a tangent T1 at point (a) with a radius (ab) and a rearward curve (63*b*) that has a tangent T2 at point (c) and a radius (cd) that intersects with radius (ab) of the forward curve (63*a*). This compound curve of the bottom edge (63) transitions without abrupt angles or barriers facilitates the smooth engagement of the shoe plate (61) with underwater obstructions that might otherwise impede navigation as the boat hull (12) moves along a waterway.

Figure 9:
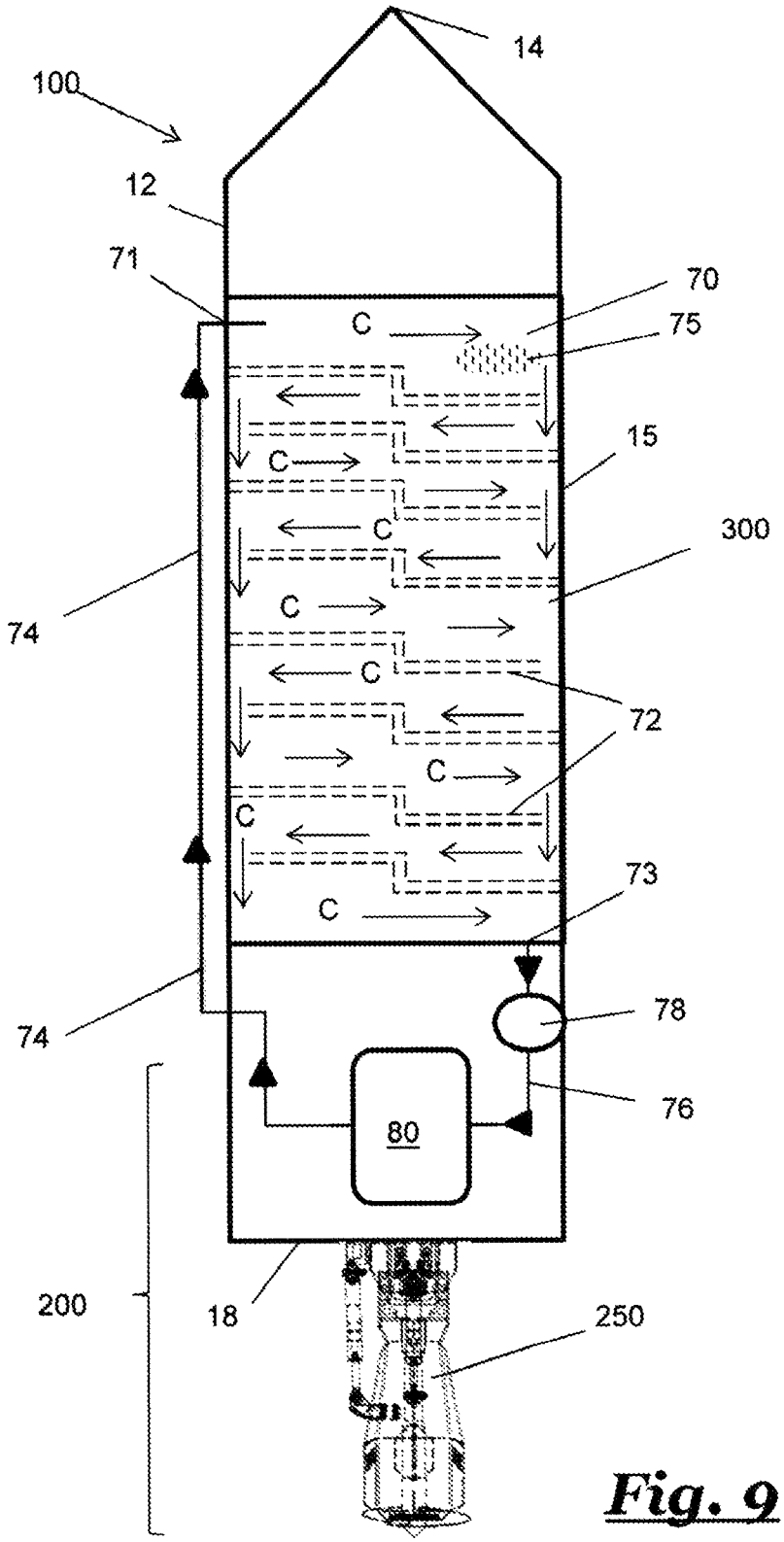
FIG. 9 is a schematic top view of the improved boat hull cooling and marine-drive system of FIG. 1 showing the integrated internally positioned onboard engine heat exchanger assembly of the marine-drive system of FIG. 1.

FIG. 9, a schematic top view, and FIG. 10, a schematic cross-section view, show an embodiment of the integrated internally positioned onboard engine heat exchanger assembly (300) of the boat hull cooling and marine-drive system (100) that is utilized for cooling the engine (80) of the marine-drive assembly (200). The integrated internally positioned onboard engine heat exchanger assembly (300) shown in FIGS. 9 and 10 is comprised of a single coolant tank (70) with coolant circulation lines (74) and (76). Coolant tank (70) incorporates the sidewalls (15) and the shallow V-shaped bottom surfaces (21) of boat hull (12) into the sides and bottom of coolant tank (70). A quantity of coolant fluid (75) is retained in the coolant tank (70). The coolant fluid (75) may be any suitable engine coolant including a coolant fluid comprised of water, alcohol, oil, synthetic oil, or combinations thereof.

Positioned within the coolant tank (70) is a plurality of internal baffle plates (72) that are staggered at the tank side surfaces. Preferably the baffle plates (72) will have bends are angles that will serve to channel a flow (C) of coolant fluid (75) through the coolant tank (70) as hot coolant fluid is introduced into the coolant tank (70) at coolant inlet (71) and cooled coolant fluid removed from the coolant tank (70) at coolant outlet (73). As shown in FIG. 9 the baffle plates (72) are constructed with bends or angles at approximately 90 degrees, but baffle plates (72) with bends at other angles could be utilized. Because the sidewalls (15) and bottom surface (21) of the boat hull (12) are resting in the waterway (W) at or below the water surface (WS) and above the water bottom (WB), the sidewalls (15) and bottom surface (21) serve as a heat exchanger as engine from said flow (C) of coolant fluid (75) is dissipated from the coolant tank (70) to the waterway (W) through the bottom (21) and sidewalls (15) of the boat hull (12) as the flow (C) of coolant circulates through the coolant tank (70).

Coolant circulation line (74) delivers a flow (C) of hot coolant from the engine (80) at coolant inlet (71) into the coolant tank (70) and coolant circulation line (76) delivers a flow (C) of cooled coolant fluid (75) from the coolant tank (70) via coolant outlet (73) to the engine (80). A coolant pump (78) is provided to enhance the flow (C) of coolant fluid (75) to and from the coolant tank (70). The exchanger assembly (300) may also be provided with two or more coolant tanks (70).

Figure 11:
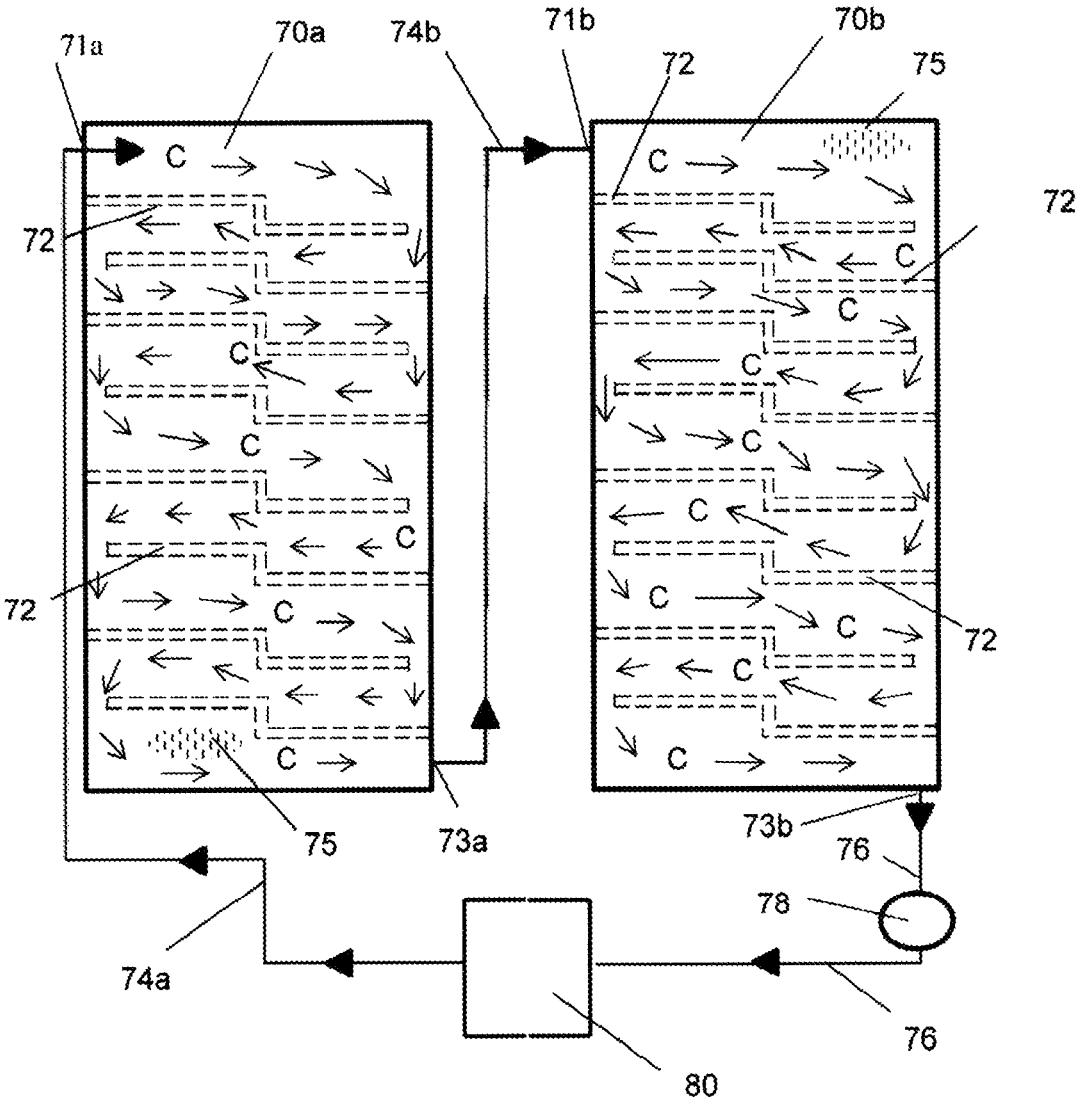
FIG. 11 is schematic top view of an alternate embodiment of the integrated internally positioned onboard engine heat exchanger assembly of the marine-drive system of the combined boat hull cooling and marine-drive system of FIG. 1 showing dual heat exchangers.

FIG. 11, a schematic top view, and FIG. 12, a schematic cross-section view, show an alternate embodiment of the integrated internally positioned onboard engine heat exchanger assembly (300). In this embodiment the integrated internally positioned onboard engine heat exchanger assembly (300) has dual coolant tanks (70*a*) and (70*b*) that are positioned on opposite sides of the boat hull (12) for cooling the engine (80) of the boat hull cooling and marine-drive system (100). The sides and bottom of each coolant tank (70*a*) and (70*b*) incorporates the sidewalls (15) and bottom surface (21) of the boat hull (12). Each coolant tank (70*a*) and (70*b*) has a plurality of internal baffle plates (72) as previously described, each housing a quantity of cooling fluid (75). A flow (C) of hot coolant fluid (75) from engine (80) is introduced into the first coolant tank (70*a*) from first coolant circulation line (74*a*) through coolant inlet (71*a*) to circulate through coolant tank (70*a*) where the coolant fluid (75) is cooled by dissipation of heat from the coolant tank (70*a*) to the waterway (W) through the bottom (21) and sidewalls (15) of the boat hull (12). The flow (C) of coolant fluid (75) then exits the first coolant tank (70*a*) through coolant outlet (73*a*) into a second coolant circulation line (74*b*) where the coolant fluid (75) is directed to enter coolant tank (70*b*) at coolant inlet (71*b*). The flow (C) of the coolant fluid (75) then circulates through coolant tank (70*b*) along the baffle plates (72) and is further cooled by dissipation of heat from the coolant tank (70*b*) to the waterway (W) through the bottom (21) and sidewalls (15) of the boat hull (12) where it then exits coolant tank (70*b*) through coolant outlet (73*b*) to circulation line (76) where the cooled coolant fluid (75) is delivered to the engine (80). Coolant pump (78) enhances the flow (C) of the coolant fluid (75) to and from the coolant tanks (70*a*) and (70*b*).

Preferably the boat hull (12) will be constructed of metal such as a structural aluminum alloy or stainless steel that will enhance the transmission of heat to the waterway (W) as the flow (C) of coolant circulates in the coolant tanks (70), (70*a*) and (70*b*). The coolant tanks (70), (70*a*) and (70*b*) and coolant circulation lines (74), (74*a*), (74*b*) and (76) of the integrated internally positioned onboard engine heat exchanger assemblies (300) are maintained entirely within the boat hull (12). This minimizes the risk of damage to these components from striking the water bottom or water obstacles as the boat hull propelled along a waterway. Similarly, there is little to no risk of mud and other debris clogging or impeding the transmission of heat from the coolant tanks (70), (70*a*) and (70*b*) to reduce its effectiveness, as the sidewalls (15) and bottom surface (21) of the boat hull (12) because mud and other debris will be washed away from the bottom (21) and sidewalls (15) as the boat hull (12) is propelled along a waterway to prevent such mud and debris from coating or becoming lodged on the boat hull (12).

While the boat hull cooling and marine-drive system (100) is primarily intended for use in a shallow water bottom environment where a variety of obstacles may be encountered, it will serve equally well in a deeper water environment which makes the boat hull cooling and marine-drive system (100) particularly useful.

The description and drawings provided herein are to show only exemplary embodiments of the boat hull cooling and marine-drive system (100) as the invention can be practiced by other than that described and illustrated. Changes may also be made in the form, construction, and arrangement of the other parts of the described boat hull cooling and marine-drive system (100) without departing from the spirit and scope of the invention or sacrificing any material advantages.

I claim:

1. A boat hull cooling and marine-drive system comprising:

(a) a boat, said boat having a boat hull with a bow, a stern, a transom, sidewalls, a bottom surface;

(b) a marine-drive system, said marine-drive system having a steering assembly attached to said boat hull and an onboard fluid cooled engine;

(c) an onboard engine heat exchanger assembly, said heat exchanger assembly having a coolant tank incorporated into said sidewalls and said bottom surface of said boat hull; and (d) a plurality of internal baffle plates positioned within said coolant tank of said onboard engine heat exchanger assembly;

(e) wherein said steering assembly is comprised of an outer ring pivotally mounted between an upper drive assembly support plate and a lower drive assembly support plate whereby said outer ring may pivot horizontally and an inner ring pivotally mounted within said outer ring whereby said inner ring may pivot vertically;

(f) a drive shaft housing support pivotally mounted on said outer ring;

(g) a rotatable longitudinally extending drive shaft positioned within said driveshaft housing; and (h) a propeller mounted to said drive shaft.

2. The boat hull cooling and marine-drive system recited in claim 1 further comprising:

(a) coolant fluid within said coolant tank;

(b) a first coolant circulation line extending between said engine and a coolant inlet into said coolant tank whereby a flow of said coolant fluid is delivered to said coolant tank;

(c) a second coolant circulation line extending between a coolant outlet from said coolant tank and said engine whereby a flow of said coolant fluid from said coolant tank is delivered to said engine; and (d) wherein heat from said coolant tank is dissipated through said sidewalls and said bottom surface of said boat hull.

3. A boat hull cooling and marine-drive system comprising:

(a) a boat, said boat having a boat hull with a bow, a stern, a transom, sidewalls, a bottom surface;

(b) a marine-drive system, said marine-drive system having a steering assembly attached to said boat hull and a fluid cooled engine;

(c) an onboard engine heat exchanger assembly, said heat exchanger assembly having a coolant tank incorporated into said sidewalls and said bottom surface of said boat hull;

(d) a plurality of internal baffle plates positioned within said coolant tank of said onboard engine heat exchanger assembly;

(e) coolant fluid within said coolant tank;

(f) a first coolant circulation line extending between said engine and a coolant inlet into said coolant tank whereby a flow of said coolant fluid is delivered to said coolant tank;

(g) a second coolant circulation line extending between a coolant outlet from said coolant tank and said engine whereby a flow of said coolant fluid from said coolant tank is delivered to said engine;

(h) wherein heat from said coolant tank is dissipated through said sidewalls and said bottom surface of said boat hull;

(i) a transom attachment plate whereby said steering assembly is attached to said transom of said boat hull;

(j) an upper drive assembly support plate;

(k) a lower drive assembly support plate;

(l) an outer ring mounted pivotally mounted between said upper drive assembly support plate and said lower drive assembly support plate whereby said outer ring may pivot horizontally;

(m) an inner ring pivotally mounted within said outer ring whereby said inner ring may pivot vertically;

(n) a pair of drive shaft housing supports, a drive shaft housing support of said pair of drive shaft housing supports pivotally mounted on opposite sides of said outer ring;

(o) a longitudinally extending drive shaft housing mounted between said pair of drive shaft housing supports;

(p) a rotatable mounted longitudinally extending drive shaft positioned within said driveshaft housing;

(q) a propeller mounted to said drive shaft;

(r) a shoe plate mounted below said longitudinally extending drive shaft housing; and (s) a stabilizer having an upwardly angled rear fin mounted above said longitudinally extending drive shaft housing at a position forward of said propeller.

4. The boat hull cooling and marine-drive system recited in claim 3 further comprising:

(a) a drive shaft elevator assembly comprising a pivotally attached hydraulic elevator cylinder with an extendable and retractable elevator cylinder piston rod whereby retraction and extension of said elevator cylinder piston rod will raise and lower said drive shaft housing and said longitudinally extending drive shaft; and (b) a lateral turning assembly comprising a pivotally attached hydraulic steering cylinder with an extendable and retractable steering cylinder piston rod whereby retraction and extension of said steering cylinder piston will transversely turn said drive shaft housing and said longitudinally extending drive shaft to the left and right.

5. The boat hull cooling and marine-drive system recited in claim 4 wherein said onboard engine heat exchanger assembly is further comprised of a pump whereby said coolant fluid is circulated though said first coolant circulation line, through said coolant tank, through said second coolant circulation line to said engine, and from said engine to said first coolant circulation line.

6. The boat hull cooling and marine-drive system recited in claim 5 wherein said wherein said onboard engine heat exchanger assembly includes dual coolant tanks.

7. The boat hull cooling and marine-drive system recited in claim 6 wherein said wherein said coolant tanks of said onboard engine heat exchanger assembly do not protrude from the bottom surface of said boat hull.

8. The boat hull cooling and marine-drive system recited in claim 7 wherein said longitudinally extending drive shaft of said steering assembly is rotated by said engine.

9. The boat hull cooling and marine-drive system recited in claim 8 wherein said marine drive system is controlled from a cockpit within said boat.

10. A boat hull cooling and marine-drive system comprising:

(a) a boat comprised of a boat hull with a bow, a stern, a transom, sidewalls, and a bottom surface;

(b) a marine-drive system having a longitudinally rearward extending steering assembly attached to said boat hull, said steering assembly having an upper drive assembly support plate and a lower drive assembly support plate pivotally supporting a horizontally pivotable outer ring, a vertically pivotable inner ring pivotally mounted within said outer ring, a drive shaft housing support pivotally mounted on said outer ring, a rotatable pivotally mounted longitudinally extending drive shaft positioned within said driveshaft housing;

(c) a fluid cooled engine;

(d) an onboard heat exchanger assembly having a coolant tank holding a quantity of coolant fluid incorporated into said sidewalls and said bottom surface of said boat hull, said coolant tank holding a quantity of coolant fluid; and (e) a plurality of internal baffle plates positioned within said coolant tank.

11. The boat hull cooling and marine-drive system recited in claim 10 wherein said onboard engine heat exchanger assembly includes a pump and fluid circulation lines whereby said coolant fluid is circulated though said coolant tank to and from said engine heat from said coolant tank thereby dissipating engine heat from said coolant fluid through said sidewalls and said bottom surface of said boat hull.

12. A boat hull cooling and marine-drive system comprising:

(a) a boat comprised of a boat hull with a bow, a stern, a transom, sidewalls, and a bottom surface;

(b) a marine-drive system having a longitudinally rearward extending steering assembly attached to said boat hull;

(c) a fluid cooled engine;

(d) an onboard heat exchanger assembly having a coolant tank incorporated into said sidewalls and said bottom surface of said boat hull;

(e) a plurality of internal baffle plates positioned within said coolant tank;

(f) a quantity of coolant fluid within said coolant tank;

(g) wherein said onboard engine heat exchanger assembly includes a pump and fluid circulation lines whereby said coolant fluid is circulated though said coolant tank to and from said engine heat from said coolant tank thereby dissipating engine heat from said coolant fluid through said sidewalls and said bottom surface of said boat hull;

(h) wherein said steering assembly is comprised of an outer ring pivotally mounted between an upper drive assembly support plate and a lower drive assembly support plate whereby said outer ring may pivot horizontally; and (b) an inner ring pivotally mounted within said outer ring whereby said inner ring may pivot vertically;

(c) a drive shaft housing support pivotally mounted on said outer ring;

(d) a rotatable mounted longitudinally extending drive shaft positioned within said driveshaft housing; and (e) a propeller mounted to said drive shaft.

13. The boat hull cooling and marine-drive system recited in claim 12, wherein said steering assembly is further comprised of:

(a) a pivotally attached hydraulic elevator cylinder with an extendable and retractable elevator cylinder piston rod whereby retraction and extension of said elevator cylinder piston rod will raise and lower said drive shaft housing and said longitudinally extending drive shaft; and (b) a pivotally attached hydraulic steering cylinder with an extendable and retractable steering cylinder piston rod whereby retraction and extension of said steering cylinder piston will transversely turn said drive shaft housing and said longitudinally extending drive shaft.

14. The boat hull cooling and marine-drive system recited in claim 13 wherein said heat exchanger assembly includes at least two coolant tanks.

15. The boat hull cooling and marine-drive system recited in claim 14 wherein said wherein said coolant tanks of said onboard engine heat exchanger assembly do not protrude from the bottom surface of said boat hull.

16. The boat hull cooling and marine-drive system recited in claim 15 further comprising a stabilizer assembly, said stabilizer assembly comprising:

(a) a shoe plate mounted below said longitudinally extending drive shaft housing; and (b) a horizontal stabilizer having an upwardly angled rear fin that terminates forward of said propeller.

17. The boat hull cooling and marine-drive system recited in claim 16 wherein said shoe plate has as bottom edge comprised of a compound curve having a forward curve and a rearward curve with intersecting tangents whereby said compound curve of said bottom edge transitions without abrupt angles.

18. The boat hull cooling and marine-drive system recited in claim 17 wherein said longitudinally extending drive shaft of said steering assembly is rotated by said engine.

* * * * *